US008333547B2

(12) United States Patent
Hsu et al.

(10) Patent No.: US 8,333,547 B2
(45) Date of Patent: Dec. 18, 2012

(54) MULTIPLE-MOTOR BLOWER AND IMPELLER THEREOF

(75) Inventors: Wei-Chun Hsu, Taoyuan Hsien (TW); Shun-Chen Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1269 days.

(21) Appl. No.: 11/898,320

(22) Filed: Sep. 11, 2007

(65) Prior Publication Data

US 2008/0063532 A1 Mar. 13, 2008

(30) Foreign Application Priority Data

Sep. 12, 2006 (TW) ..... 95133593 A

(51) Int. Cl.
*F01D 1/24* (2006.01)

(52) U.S. Cl. ..... 415/60

(58) Field of Classification Search ..... 415/60, 415/62, 63, 182.1, 203, 26, 224, 183, 220; 417/423.5

See application file for complete search history.

(56) References Cited

U.S. PATENT DOCUMENTS

| | | | | |
|---|---|---|---|---|
| 957,607 | A * | 5/1910 | Higgins | 415/60 |
| 3,236,298 | A * | 2/1966 | Laing | 165/124 |
| 3,644,066 | A * | 2/1972 | Heob et al. | 417/354 |
| 5,988,979 | A * | 11/1999 | Wang | 416/178 |
| 7,417,856 | B2 * | 8/2008 | Chiu et al. | 361/695 |
| 7,458,767 | B2 * | 12/2008 | Wu et al. | 415/60 |
| 7,529,088 | B2 * | 5/2009 | Chiu et al. | 361/695 |
| 2002/0159885 | A1 * | 10/2002 | Liang et al. | 415/206 |

* cited by examiner

*Primary Examiner* — Edward Look
*Assistant Examiner* — Ryan Ellis
(74) *Attorney, Agent, or Firm* — Birch, Stewart, Kolasch & Birch, LLP

(57) ABSTRACT

A multiple-motor blower includes a housing and a plurality of motors. The housing has a common outlet passage and different inlet passages. The motors are accommodated in the housing and respectively drive impellers to generate airflow flowing from the inlet passages to the outlet passage. Each of the impellers includes a hub and a plurality of blades mounted around a circumference of the hub. A ratio of a distance between adjacent two of the blades to a thickness of the blade in at least one of the impellers is smaller than or equal to 3.

11 Claims, 9 Drawing Sheets

4

MULTIPLE-MOTOR BLOWER AND IMPELLER THEREOF

CROSS REFERENCE TO RELATED APPLICATIONS

This Non-provisional application claims priority under 35 U.S.C. §119(a) on Patent Application No. 095133593 filed in Taiwan, Republic of China on Sep. 12, 2006, the entire contents of which are hereby incorporated by reference.

BACKGROUND OF THE INVENTION

1. Field of Invention

The invention relates to a blower and an impeller thereof and in particular, to a multiple-motor blower and an impeller thereof.

2. Related Art

Typical blowers are classified into the single-side entry blowers and the double-side entry blowers. FIG. 1A is a schematic illustration showing a single-side entry blower 1 with a single impeller, and FIG. 1B is a cross-sectional view taking along a straight line A-A' shown in FIG. 1A. Referring to FIGS. 1A and 1B, the blower 1 includes a motor 10, which is accommodated in a housing 11 and drives an impeller 12 to rotate. The housing 11 includes an upper cover 111, a lower cover 112 and an outlet 113. The upper cover 111 includes an inlet 114. When the impeller 12 rotates, a plurality of blades 121 mounted around the periphery of the impeller 12 drives the airflow from the inlet 114 to the outlet 113. However, when the motor 10 breaks down, the blower 1 loses the heat dissipating ability.

In order to prevent the aforementioned disadvantage, two blowers are combined together according to the prior art. Referring to FIGS. 2A and 2B, a conventional combined blower 2 has a first blower 21 and a second blower 22. The first blower 21 has an inlet 211 and an outlet 212, and the second blower 22 has an inlet 221 and an outlet 222. The outlet 212 of the first blower 21 is extended through a hollow housing 213, and the outlet 212 and the outlet 222 of the second blower 22 are aligned so that the second blower 22 is stacked on the hollow housing 213.

The first and second blowers 21, 22 drive the airflow from the inlets 211, 221, respectively, so that the airflow enters the individual air passages and is outputted from the outlets 212 and 222, respectively. That is, the first blower 21 and the second blower 22 are independent each other. In this case, a larger space is required to accommodate the two blowers, and additional components, such as the hollow housing 213, are required to combine the blowers together. Thus, the material cost is increased, and the overall airflow property of the combined blower 2 cannot be enhanced. In addition, when any one of the blowers breaks down, the faulty blower cannot be driven by the airflow generated by the blower which operates normally.

Thus, it is an important subject to provide a multiple-motor blower and an impeller thereof to integrate the structure design and to save the material cost, wherein when any one of the impellers breaks down, the faulty impeller can be driven by the other impeller operating normally so that the heat dissipating reliability and efficiency can be enhanced.

SUMMARY OF THE INVENTION

In view of the foregoing, the invention is to provide a multiple-motor blower and an impeller thereof, wherein the airflow property of the blower can be enhanced according to the dense blades and the integrated structure. Moreover, when one impeller breaks down, the other impeller that can work normally can drive the one impeller to rotate so that the heat dissipating reliability and efficiency can be ensured, and the effect of saving the power may be achieved.

To achieve the above, a multiple-motor blower according to the invention includes a housing and two motors. The housing has one common outlet passage and two inlet passages for the two motors, respectively. The two motors are disposed in the housing and respectively drive the impellers to generate airflow flowing from the inlet passages to the outlet passage. The impellers have reverse rotation directions.

To achieve the above, the invention also discloses a multiple-motor blower including a housing and two motors. The housing has a common outlet passage and two inlet passages for the two motors, respectively. The two motors are disposed in the housing and respectively drive the impellers to generate airflow flowing from the inlet passages to the outlet passage. The impeller includes a hub and a plurality of blades mounted around the hub. A ratio of a distance between two adjacent blades to a thickness of the blade is smaller than or equal to 3.

In addition, the invention discloses an impeller for a motor. The impeller includes a hub and a plurality of blades. The blades are mounted around the hub. A ratio of a distance between two adjacent blades to a thickness of one of the two adjacent blades is smaller than or equal to 3.

As mentioned above, the multiple-motor blower of the invention has two motors and a housing having different inlet passages and one common outlet passage. The two motors drive the impellers to rotate in reverse rotation directions each other, and a ratio of a distance between two adjacent blades to a thickness of one of the blades in at least one impeller is smaller than or equal to 3. Compared with the conventional blower, the two different motors with corresponding impellers are configured to have reverse rotation directions and/or the dense blades are integrated in the multiple-motor blower in this invention. If any one motor breaks down and can not drive the corresponding impeller, the other impeller that normally rotates brings a portion of the airflow to push the faulty impeller to move through the air-guiding structure. In addition, the blades arranged densely in conjunction with the different blade curvatures can prevent the airflow from flowing reversely from the inlet passage. Thus, the invention can ensure the heat dissipating reliability and efficiency, and, thus the power may be saved.

BRIEF DESCRIPTION OF THE DRAWINGS

The invention will become more fully understood from the subsequent detailed description and the accompany drawings, which are given by way of illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
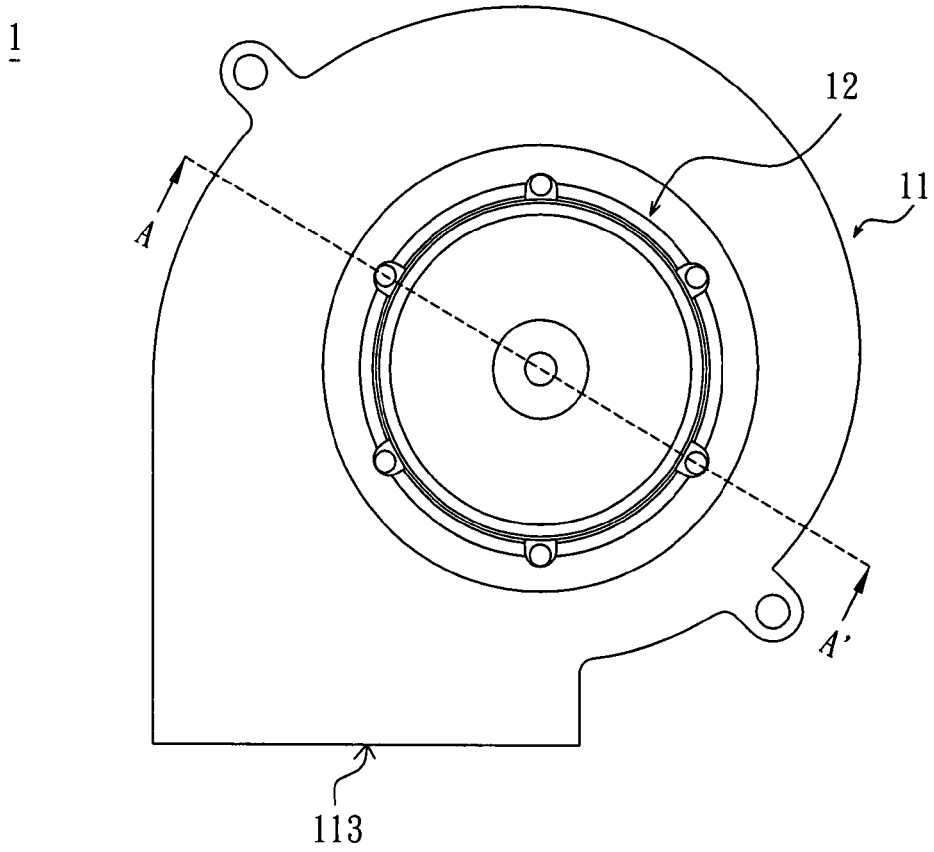
FIG. 1A(PRIOR ART)
FIG. 1A is a top view showing a conventional blower having one impeller.
Figure 1B:
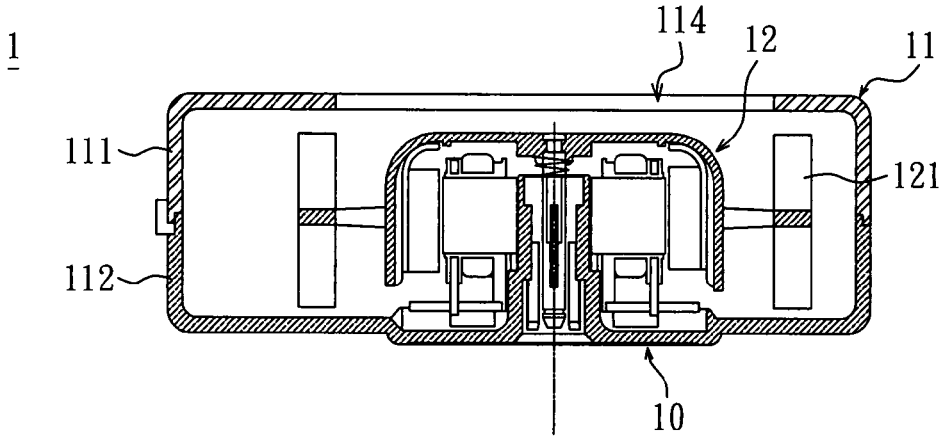
FIG. 1B(PRIOR ART)
FIG. 1B is a cross-sectional view taken along a line A-A' of FIG. 1A.
Figure 2A:
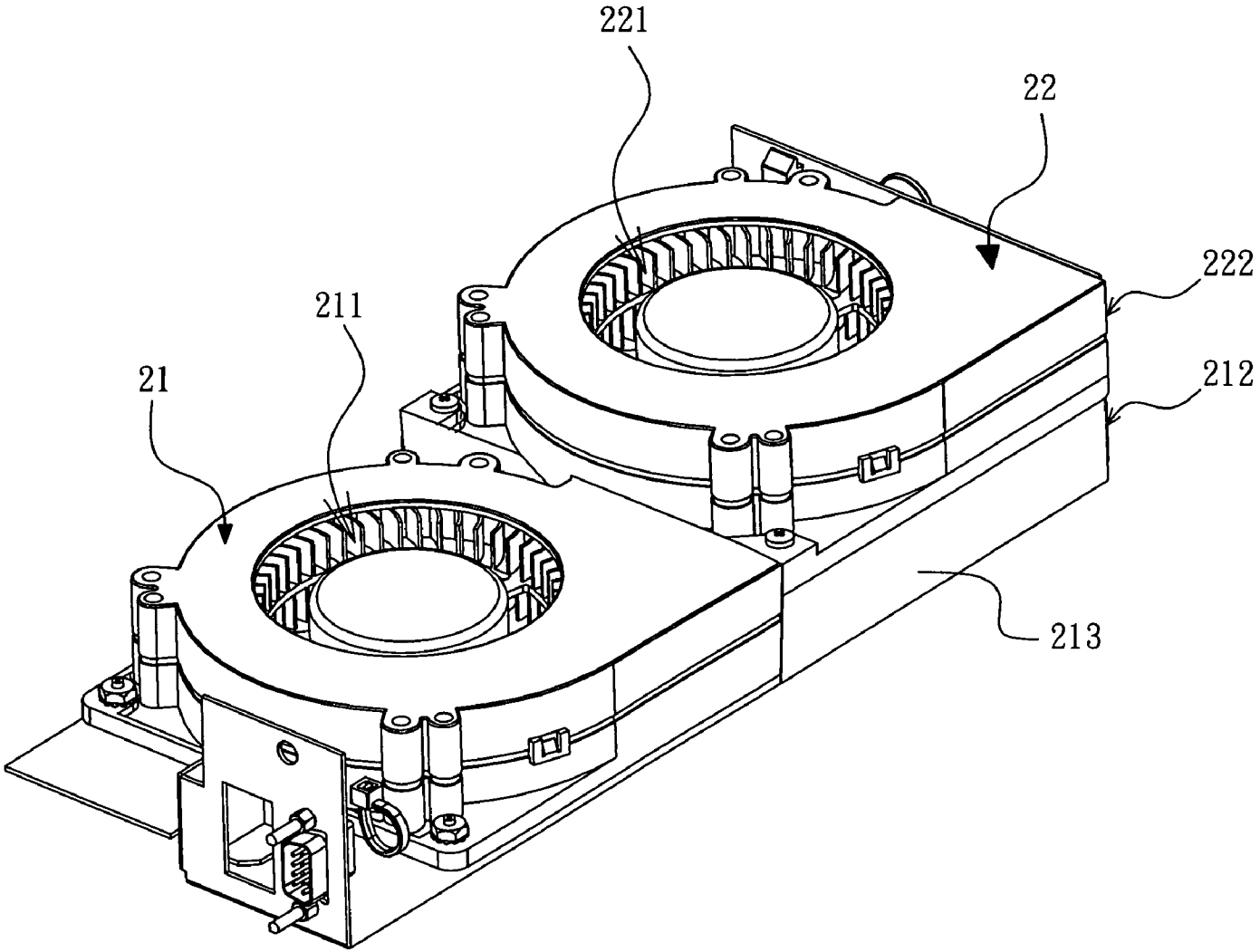
FIG. 2A(PRIOR ART)
FIG. 2A is a schematic illustration showing a conventional combined blower.
Figure 2B:
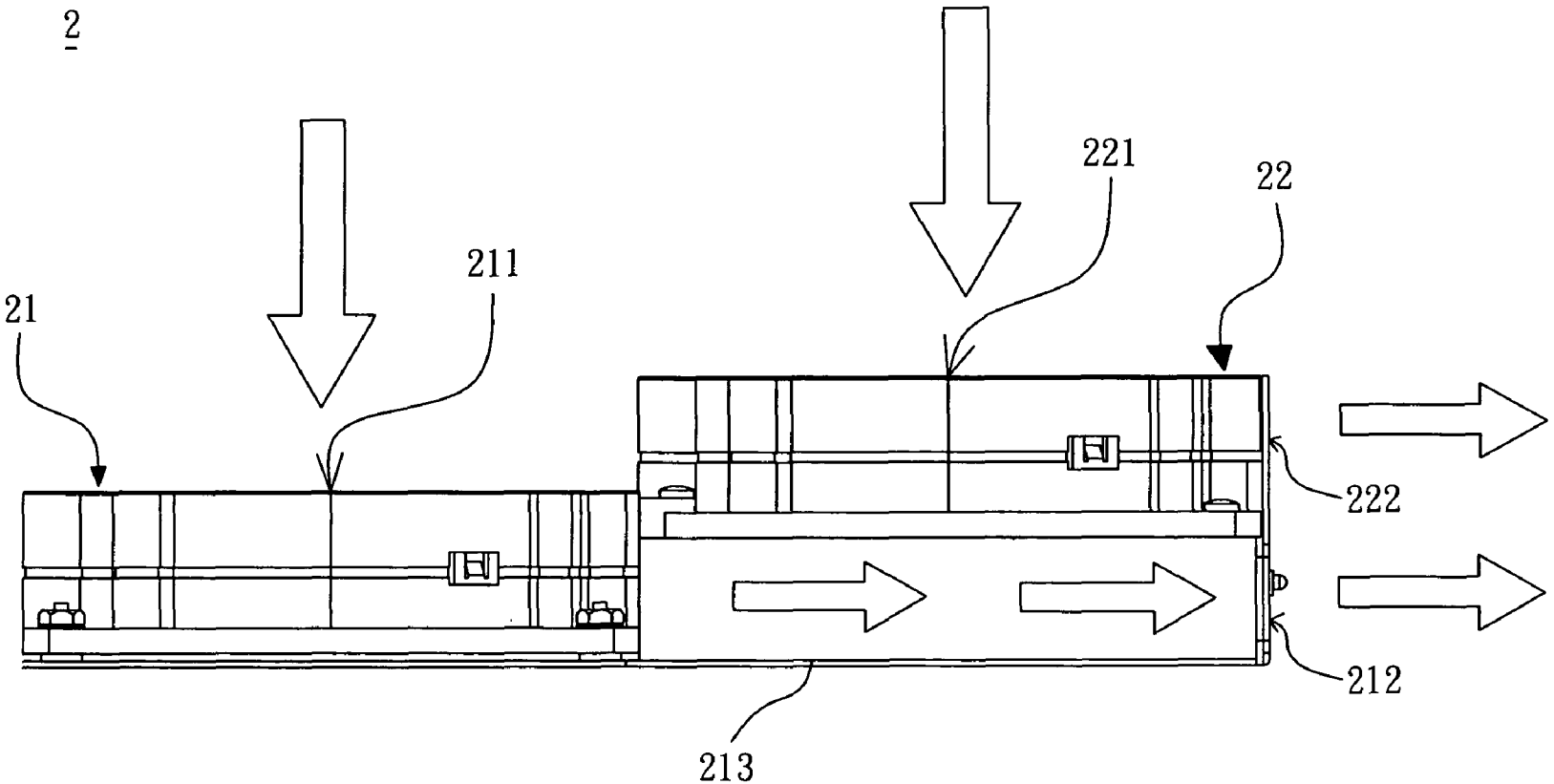
FIG. 2B(PRIOR ART)
FIG. 2B is a schematic illustration showing the airflow when the combined blower of FIG. 2A is operating.
Figure 3:
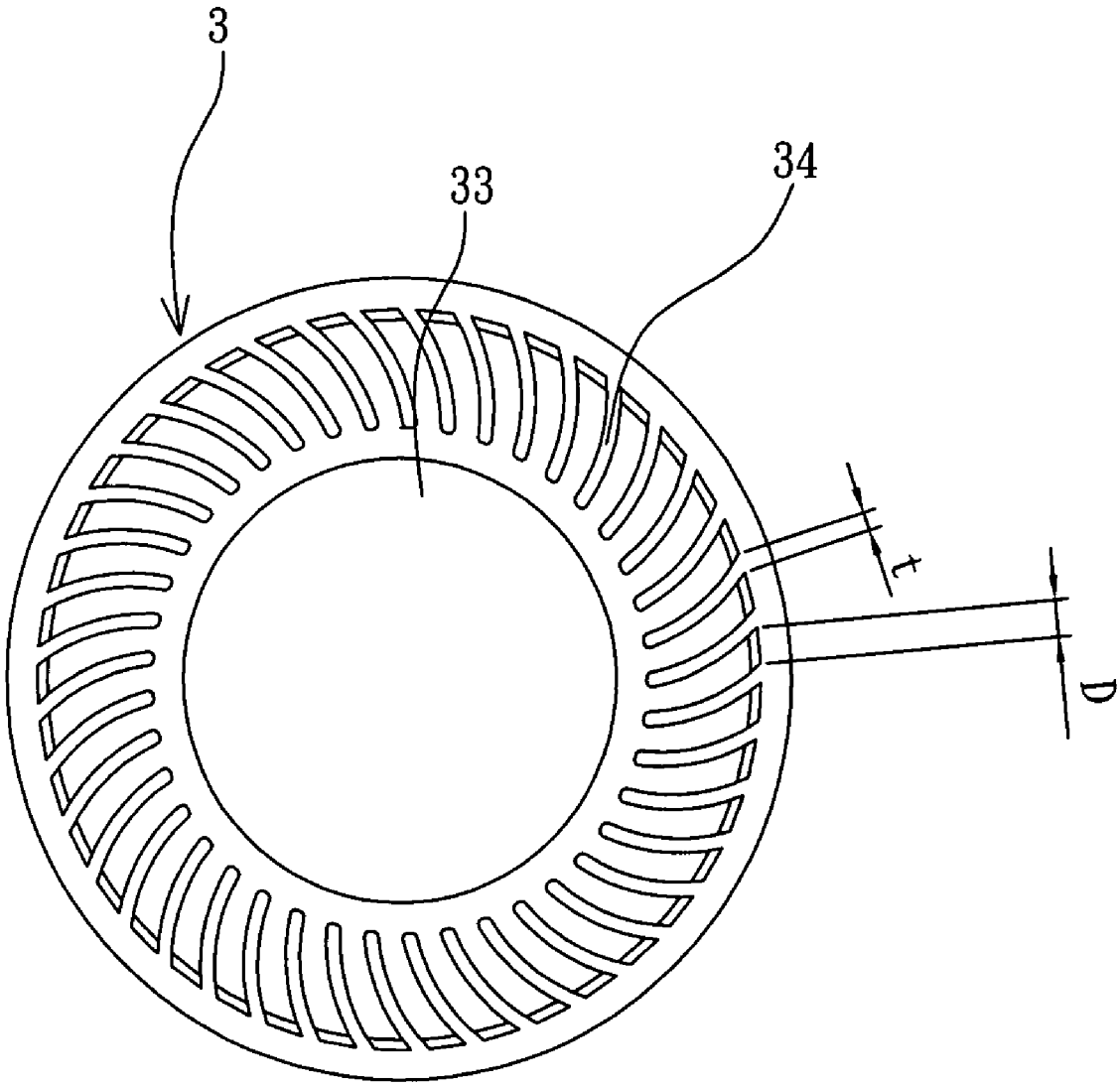
FIG. 3 is a top view of an impeller for a motor according to an embodiment of the invention.

Referring to FIG. 3, an impeller 3 according to an embodiment of the invention includes a hub 33 and a plurality of blades 34 mounted around the hub 33. The impeller 3 is a centrifugal type fan impeller. The hub 33 and the blades 34 can be formed as a monolithic piece; otherwise, the blades 34 and the hub 33 may be combined together. The blade may be a forward leaning blade, a backward leaning blade or a plate-like blade, and the blades 34 have changeable curvatures. A distance D exists between the adjacent blades of the impeller 3, and the blade 34 has a thickness t. A ratio of the distance D to the thickness t is smaller than or equal to 3. In this embodiment, the blades 34 are arranged densely, and the blades 34 are the forward leaning blades having dual curvatures. The impeller 3 may be applied to a multiple-motor blower.

Figure 4A:
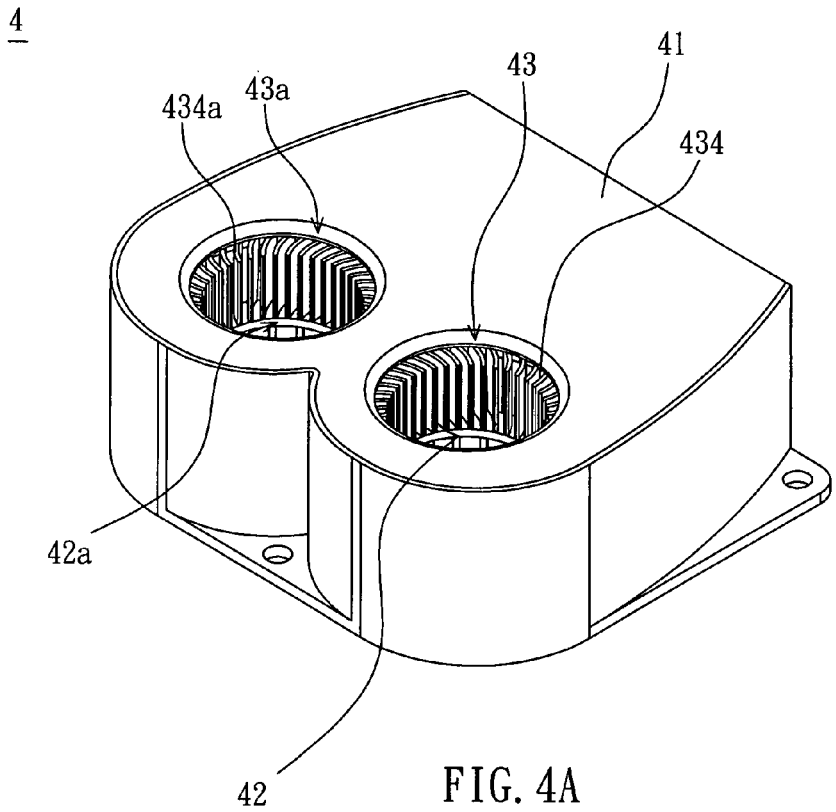
FIGS. 4A and 4B are schematic illustrations showing a multiple-motor blower according to the embodiment of the invention.
Figure 4B:
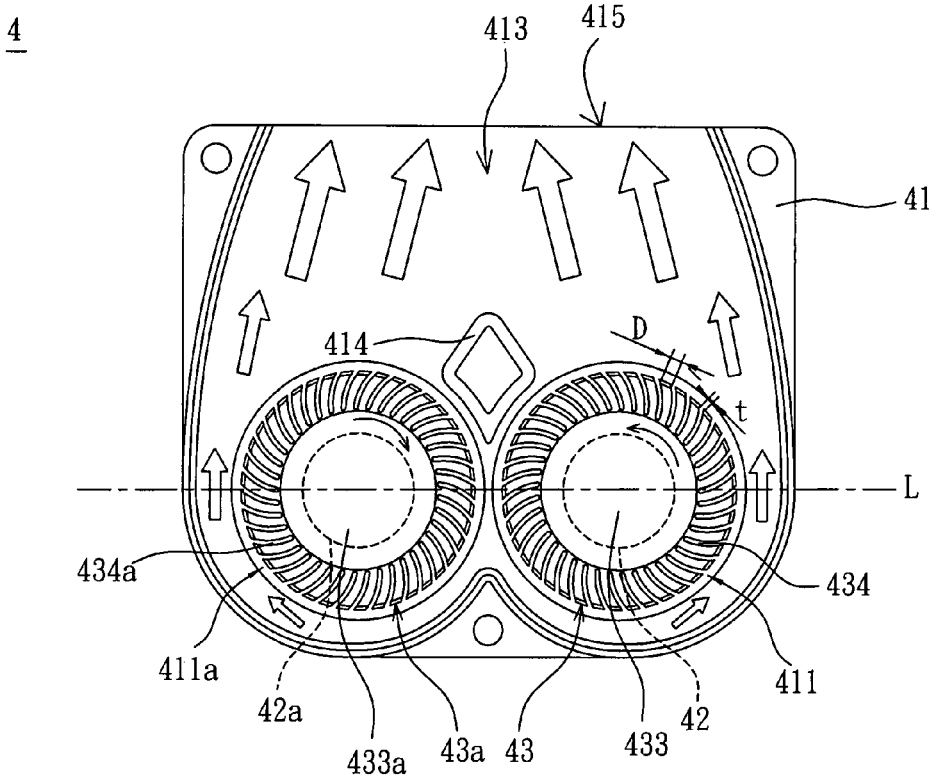

Referring to FIGS. 4A and 4B, a multiple-motor blower 4 having the above-mentioned impellers according to the embodiment of the invention includes a housing 41 and two motors 42 and 42*a* disposed in the housing 41. The motors 42 and 42*a* are arranged on a straight line and arranged symmetrically. The housing 41 has two inlet passages 411 and 411*a*. The outlet end of the housing 41 has a common outlet passage 413 for the motors 42 and 42*a*, and at least one air-guiding structure 414 is disposed between the motors 42 and 42*a*. The blower 4 has two impellers 43 and 43*a* respectively coupled to the motors 42 and 42*a*. The structures and functions of the impellers 43 and 43*a* of the embodiment are the same as those of the previously mentioned impeller 3. The impeller 43 includes a hub 433 and a blade 434 mounted around the hub 433, and the impeller 43*a* includes a blade 434*a* mounted around the hub 433*a*. The impellers 43 and 43*a* have reverse rotation directions. A ratio of the distance D between the two adjacent blades to a thickness t of the blade in the impeller 43 or 43*a* is smaller than or equal to 3.

As shown in FIG. 4B, the operations and the airflow directions of the multiple-motor blower 4 in this embodiment will be described in the following. When the motors 42 and 42*a* respectively drive the impellers 43 and 43*a* to rotate, the impeller 43 is preferably rotated counterclockwise and the impeller 43*a* is preferably rotated clockwise. The impellers 43 and 43*a* suck the airflow from the inlet passages 411 and 411*a*, respectively, and the airflow flows through the fluid passage and is then converged at the outlet passage 413 of the housing 41. It is to be noted that the dense blades 434 and 434*a* of the motors 42 and 42*a*, respectively, stably converge the airflow to the outlet passage 413 to achieve the heat dissipating function according to the designs of the enlarged blade curvature and the air-guiding structure 414 of the housing 41. The blades 434 and 434*a*, which are arranged densely, can block the airflow, and the airflow cannot be easily reversed due to the enlarged curvatures of the blades 434 and 434*a*. In addition, if one of the motors 42 and 42*a* breaks down and cannot drive the corresponding impeller 43 or 43*a* to rotate, a portion of the airflow generated by the other impeller 43*a* or 43, which is normally driven by the other motor 42*a* or 42, can push the faulty impeller 43 or 43*a* to rotate in a reverse direction through the air-guiding structure 414. Therefore, the airflow can be prevented from reversing from the inlet passage. Thus, the heat dissipating reliability and efficiency can be ensured, the power can be saved, and the overall property of the multiple-motor blower 4 can be improved.

Figure 5A:
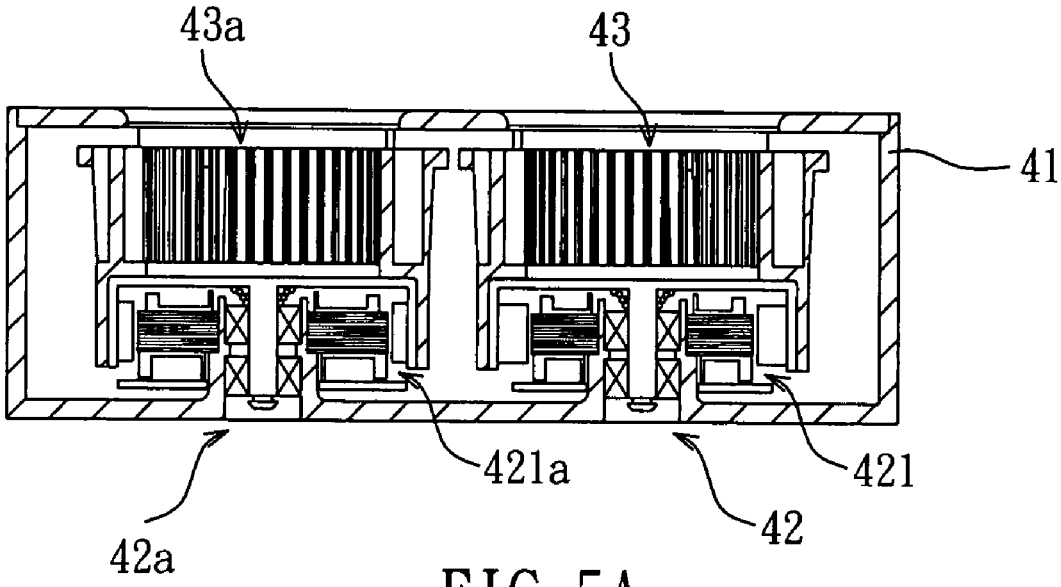
FIGS. 5A to 5C are schematic illustrations showing the multiple-motor blowers respectively having different motors, having different impellers, and having different motors and different impellers.
Figure 5B:
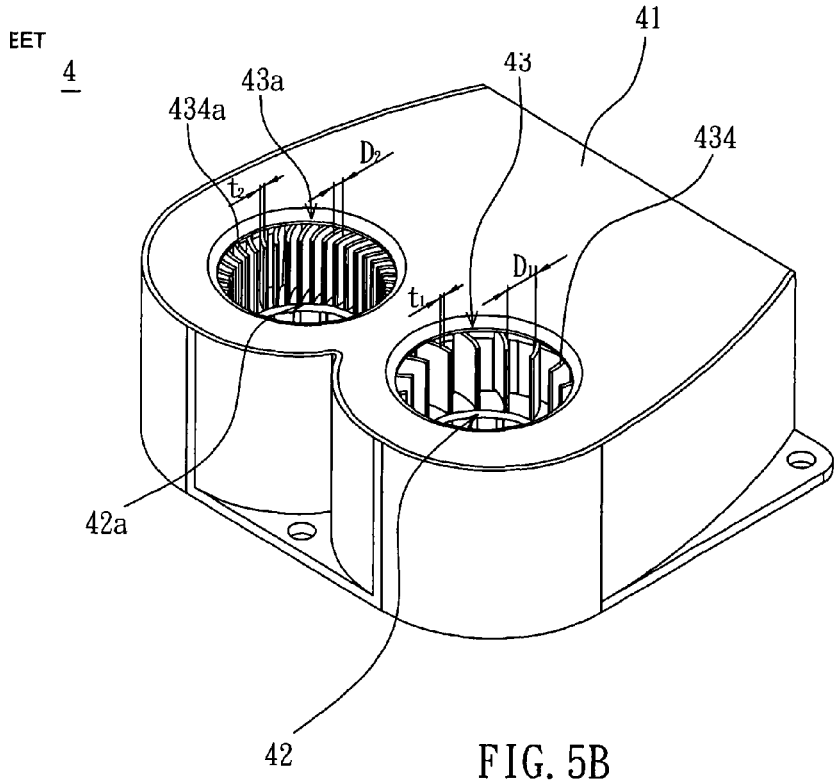
Figure 5C:
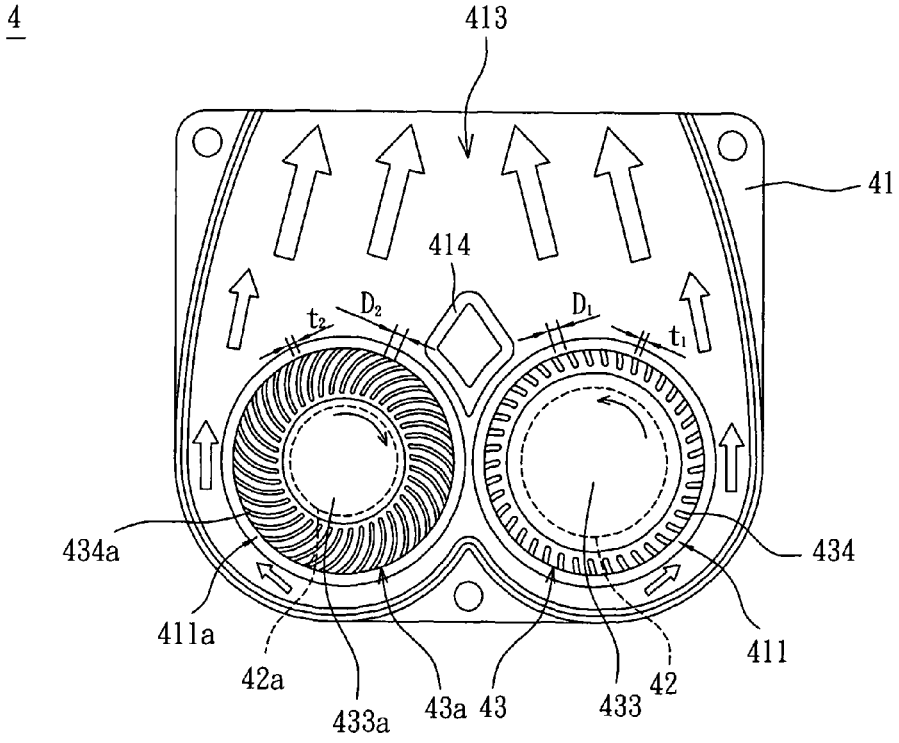

The motors 42 and 42*a* and the impellers 43 and 43*a* according to this embodiment may have different combinations according to the actual requirement. As shown in FIG. 5A, the motors 42 and 42*a* enable the motors 42 and 42*a* to have different rotating speeds and airflow quantities through different stator structures 421 and 421*a*, which have, for example, different silicon steel sheets or different winding numbers. As shown in FIG. 5B, the impellers 43 and 43*a* have different types of blades, different blade curvatures, different blade thicknesses $t_1$ and $t_2$, different distances $D_1$ and $D_2$ or different densities ($D_1/t_1$ and $D_2/t_2$). The impellers 43 and 43*a* generate the different air quantities although they are driven by the same motor. As shown in FIG. 5C, the motors 42 and 42*a* have the different stator structures 421 and 421*a* (e.g., the different silicon steel sheets or the different winding numbers) and the impellers 43 and 43*a* have different blade curvatures or densities so that the combination of the motor 42 and the impellers 43 and the combination of the motor 42*a* and the impellers 43*a* generate different rotating speeds and different air quantities.

Figure 6:
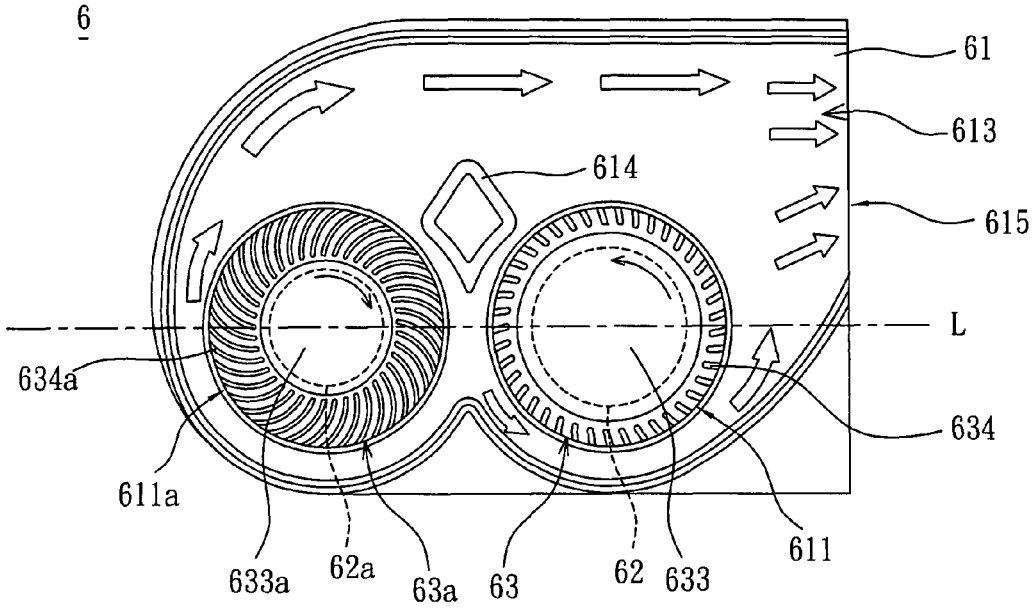
FIGS. 6 and 7 are schematic illustrations showing different arrangements of the multiple-motor blowers.

As shown in FIG. 6, a multiple-motor blower 6 according to the embodiment of the invention also has two motors, for example. The multiple-motor blower 6 includes a housing 61 and two motors 62 and 62*a* disposed in the housing 61. The housing 61 has different inlet passages 611 and 611*a*. The outlet end of the housing 61 has a common outlet passage 613 for the motors 62 and 62*a*, and at least one air-guiding structure 614 is disposed between the motors 62 and 62*a*. Similar to the above-mentioned embodiment, the motors 62 and 62*a* are different from each other, and the blade densities of impellers 63 and 63*a* are different from each other. The motors 62 and 62*a* are arranged on a straight line within the housing 61 in a manner similar to those above-mentioned. A line L connecting center points of the motors 62 and 62*a*, as shown in FIG. 6, is perpendicular to an outlet 615 of the housing 61, while the line L connecting center points of the motors 42 and 42*a*, as shown in FIG. 4B, is parallel to an outlet 415. In this case, the impellers 63 and 63*a* have reverse rotation directions, and the airflow driven by the impellers 63 and 63*a* is introduced from the inlet passages 611 and 611*a*. The airflow flows through the fluid passage and is then converged at the outlet passage 613 of the housing 61. Because the relative positional relationships between the impellers 63 and 63*a* and the outlet 615 are different from each other, the motor 62*a* is disposed at a location farther from the outlet passage 613, and the blades 634 and 634*a* are adjusted to have different curvatures and different densities. The density of the blades 634*a* is higher than that of the blades 634 so that the inlet passages 611 and 611*a* have different fluid pressures. Accordingly, higher heat dissipating efficiency can be achieved in conjunction with the air-guiding structure 614.

Figure 7:
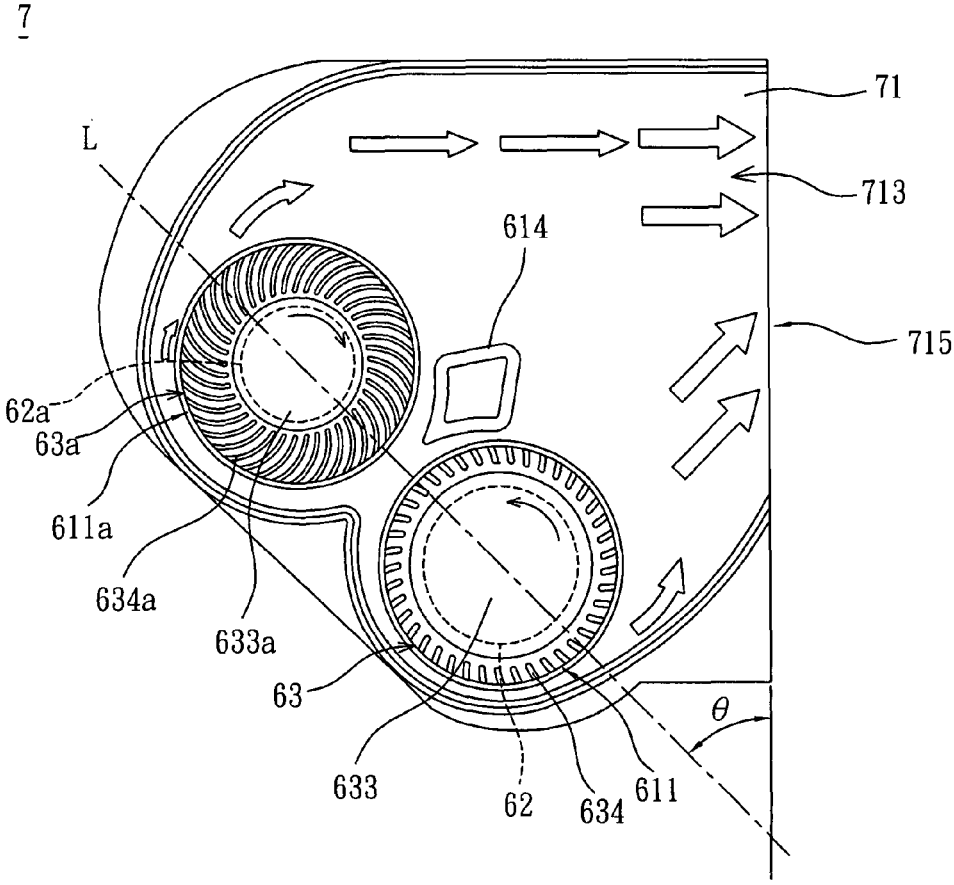

As shown in FIG. 7, the motors 62 and 62*a* are disposed unsymmetrically in a multiple-motor blower 7 according to the embodiment of the invention. The difference between the multiple-motor blower 7 and the multiple-motor blower 6 is that the line connecting the center points of the motors 62 and 62*a* (as shown in FIG. 7) forms an angle θ with the outlet 715 of the housing 71 in order to satisfy the special spatial requirement in a special heat dissipating system. The airflow flows through the fluid passage and is then converged at the outlet passage 713 of the housing 71. Because the relative positional relationships between the impellers 63 and 63*a* and the outlet 715 are different from each other, the rotating speeds of the motors 62 and 62*a* may be adjusted in conjunction with the angle θ, or the curvatures and densities of the blades 634 and 634*a* may be adjusted in conjunction with the angle θ so that better heat dissipating efficiency may be obtained.

Figure 8A:
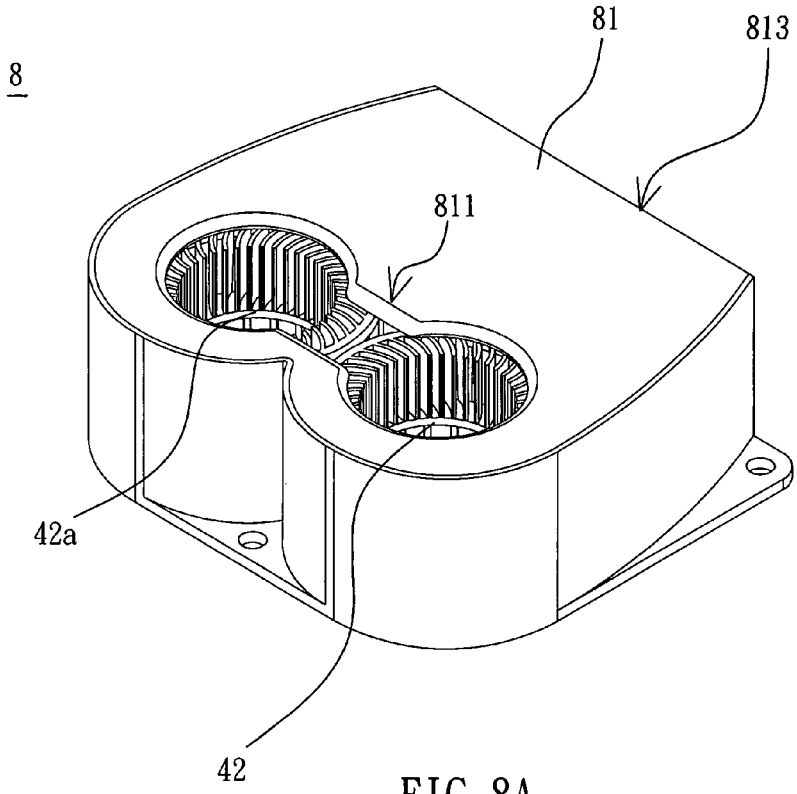
FIGS. 8A and 8B are schematic illustrations showing the multiple-motor blowers having a common inlet passage.
Figure 8B:
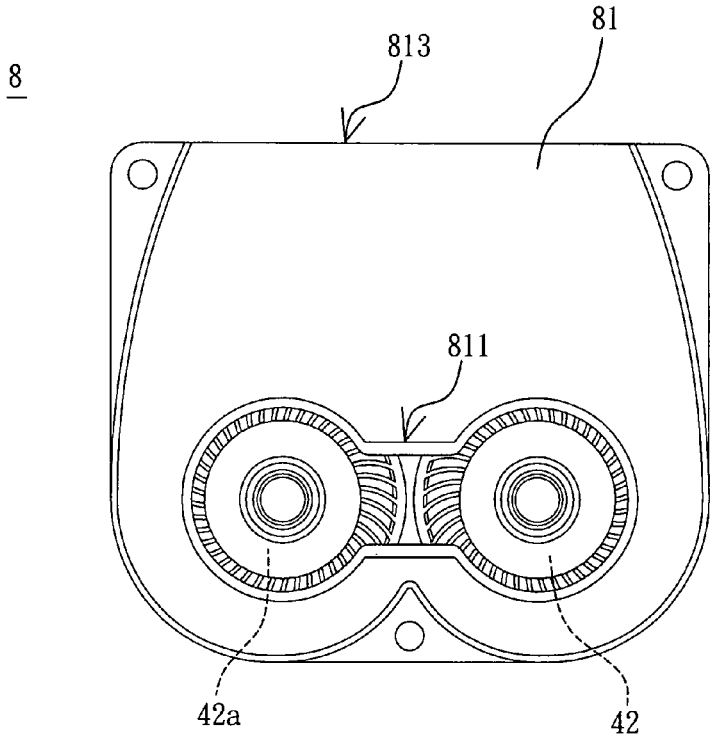

As shown in FIGS. 8A and 8B, the motors 42 and 42*a* are disposed symmetrically in a multiple-motor blower 8 according to the embodiment of the invention. The difference between the multiple-motor blower 8 and the multiple-motor blower 4 is that a common inlet passage 811 is formed in the housing 81 in order to satisfy the special spatial requirement in a special heat dissipating system. The airflow flows through the fluid passage and is then converged at the outlet passage 813 of the housing 81.

In summary, the multiple-motor blower of the invention has two motors and a housing, which has different inlet passages and one common outlet passage. The motors drive the impellers to rotate in reverse rotation directions, and a ratio of a distance between adjacent blades to a thickness of the blade in at least one impeller is smaller than or equal to 3. Compared with the prior art, two different motors or impellers are configured to have reverse rotation directions and/or the dense blades are integrated in the multiple-motor blower in this invention. If any one motor breaks down and can not drive the corresponding impeller, the other impeller that normally rotates brings a portion of the air to push the faulty impeller to move through the air-guiding structure. In addition, the blades arranged densely in conjunction with the different blade curvatures may block the airflow to prevent the air from flowing reversely from the inlet passage. Thus, the invention can ensure the heat dissipating reliability and efficiency, and, thus the power may be saved.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A multiple-motor blower comprising:

a housing having a common outlet passage and a plurality of inlet passages;

a plurality of motors accommodated in the housing for respectively driving impellers to generate airflow flowing from the inlet passages to the common outlet passage; and at least one air-guiding structure disposed in the housing and between the motors and the common outlet passage, one part of the air-guiding structure being located between the impellers, wherein if one of the impellers is faulty, the other impeller rotates and brings a portion of the airflow to push the faulty impeller to move through the air-guiding structure, and wherein the impellers have reverse rotation directions.

2. The blower according to claim 1, wherein the motors have different stator structures, different silicon steel sheets or different winding numbers.

3. The blower according to claim 1, wherein blades of the impellers have different shapes, curvatures, thicknesses, intervals or densities.

4. The blower according to claim 1, wherein the impeller comprises a hub and a plurality of blades mounted around the hub.

5. The blower according to claim 4, wherein a ratio of a distance between the two adjacent blades to a thickness of the blade is smaller than or equal to 3.

6. The blower according to claim 4, wherein the hub and the blades are formed as a monolithic piece.

7. The blower according to claim 4, wherein the blades are forward leaning blades, backward leaning blades or plate-like blades, or the blades have changeable curvatures.

8. The blower according to claim 1, wherein the motors are disposed on a straight line, disposed symmetrically or disposed unsymmetrically.

9. The blower according to claim 1, wherein a line connecting center points of the motors is parallel to or perpendicular to an outlet of the common outlet passage, or forms an angle with the outlet of the common outlet passage.

10. The blower according to claim 1, wherein the impellers rotate inwardly from the common outlet passage to a common space between the impellers.

11. A multiple-motor blower comprising:

a housing having a common outlet passage and an inlet passage;

a plurality of motors accommodated in the housing for respectively driving impellers to generate airflow flowing from the inlet passage to the common outlet passage; and at least one air-guiding structure disposed in the housing and between the motors and the common outlet passage, one part of the air-guiding structure being located between the impellers, wherein if one of the impellers is faulty, the other impeller rotates and brings a portion of the airflow to push the faulty impeller to move through the air-guiding structure, and wherein the impellers rotate inwardly from the common outlet passage to a common space between the impellers.

* * * * *